US008851041B2

(12) United States Patent
Marimbordes et al.

(10) Patent No.: US 8,851,041 B2
(45) **Date of Patent: *Oct. 7, 2014**

(54) INTAKE SYSTEM OF INTERNAL COMBUSTION ENGINE

(71) Applicant: Mann+Hummel GmbH, Ludwigsburg (DE)

(72) Inventors: Thierry Marimbordes, Bazougers (FR); Gerald De Cara, Soulgé sur Ouette (FR)

(73) Assignee: Mann + Hummel GmbH, Ludwigsburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/893,064

(22) Filed: May 13, 2013

(65) Prior Publication Data

US 2013/0319362 A1 Dec. 5, 2013

Related U.S. Application Data

(63) Continuation of application No. 13/564,866, filed on Aug. 2, 2012, now Pat. No. 8,459,225.

(30) Foreign Application Priority Data

Aug. 2, 2011 (EP) ..... 11290357

(51) Int. Cl.
*F02M 35/10* (2006.01)

(52) U.S. Cl.
CPC ..... *F02M 35/10* (2013.01); *F02M 35/10308* (2013.01); *F02M 35/10072* (2013.01); *F02M 35/10111* (2013.01); *F02M 35/10144* (2013.01); *F02M 35/10255* (2013.01)
USPC ..... 123/184.53; 123/184.58

(58) Field of Classification Search
CPC ..... F02B 27/0205; F02B 27/021; F02B 27/0294; F02M 35/10308; F02M 35/10301; F02M 35/10295
USPC ..... 123/184.53, 184.55, 184.56, 184.59
See application file for complete search history.

(56) References Cited

U.S. PATENT DOCUMENTS

| | | | |
|---|---|---|---|
| 4,538,556 A | 9/1985 | Takeda | |
| 6,830,024 B2 | 12/2004 | Kodweiss et al. | |
| 6,997,157 B2 | 2/2006 | Ikuma et al. | |
| 7,011,064 B2 | 3/2006 | Kito et al. | |

FOREIGN PATENT DOCUMENTS

| | | | | |
|---|---|---|---|---|
| EP | 0467408 A2 | | 1/1992 | |
| EP | 1284356 A2 | | 2/2003 | |
| JP | 60164619 A | * | 8/1985 | ..... F02B 27/02 |
| JP | 61116020 A | * | 6/1986 | ..... F02B 27/02 |

* cited by examiner

*Primary Examiner* — Hung Q Nguyen
(74) *Attorney, Agent, or Firm* — James Hasselbeck

(57) ABSTRACT

An intake system (10) of an internal combustion engine includes an intake manifold (12) with at least two feed pipes (14) connected with cylinder head intake ports of the internal combustion engine and includes at least one intermediate chamber (30) having connections (34) to an interior volume (24) of each feed pipe (14). Each connection (34) can be opened or closed by way of an intake control valve.

11 Claims, 4 Drawing Sheets

INTAKE SYSTEM OF INTERNAL COMBUSTION ENGINE

CROSS-REFERENCE TO RELATED APPLICATION

This application is a continuation of U.S. application Ser. No. 13/564,866 filed Aug. 2, 2012, all of the contents of which are incorporated herein by reference and to the fullest extent of the law. U.S. application Ser. No. 13/564,866 claims the benefit of EP patent application no. 11290357.0 filed Aug. 2, 2011, all of the contents of which are incorporated herein by reference and to the fullest extent of the law.

TECHNICAL FIELD

This present invention relates generally to an intake system of an internal combustion engine including an intake manifold with at least two feed pipes which are connected with intake ports of a cylinder head of the internal combustion engine; and at least one intermediate chamber, which has connections to an interior volume of each feed pipe, each connection can be opened or closed by way of at least one intake control valve.

BACKGROUND OF THE INVENTION

U.S. Pat. No. 5,603,296 discloses an intake apparatus of an engine wherein an intake section into which air flows from an air cleaner is provided with in an intake manifold. A partition wall defining a short intake passage and a long intake passage separately is installed concentrically with a circular intake manifold casing with respect to the intake section, between the intake manifold casing and the intake section. An intake control valve is switchable arranged between an upper end of the partition wall and a bent portion of the intake manifold. At least two unit shafts are spaced apart from and connected to each other to form a shaft to which the intake control valve is fixed. A driving mechanism for driving the intake control valve comprises an actuator actuated by a solenoid valve, a rod connected to the actuator and a lever rotatable connected at its one end to the rod by means of a pin and secured at its other end to the shaft.

SUMMARY OF THE INVENTION

It is an object of the invention to provide a intake system which is compact, easy to build and provides increased tightness. The object is achieved in that the at least one intake control valve comprises a switch chamber which has a connection to means for creating a subpressure in the switch chamber dependent on the operating speed, the switch chamber is separated from the interior volumes of the feed pipes and from the intermediate chamber by way of at least one diaphragm, the connections between the interior volumes of the feed pipes and the intermediate chamber can be opened or closed by the at least one diaphragm.

According to the invention at least one diaphragm is used for opening and closing one or more connections to the intermediate chamber. The diaphragm is controlled by the pressure in the switch chamber in relation to the pressures in the interior volumes of the feed pipes. The pressure in the switch chamber preferably can be controlled by the means for creating pressure. So the consumption of the internal combustion engine can be reduced. Further the output performance of the engine can be optimized. The noise emission also can be reduced. The diaphragm can easily be built. Different to the intake control valve known from the state of the art mechanical parts such as rods or levers are not needed. The influence of tolerances of the parts on the tightness of the sealing by means of the diaphragm is smaller compared to intake control valves known from the state of the art.

According to an advantageous embodiment of the invention the means for creating a pressure can be controlled by the engine electronic control unit (ECU). In the ECU the conditions under which the intake control valve is opened can be specified. With the ECU a defined activation of the intake control valve is possible. So the intake control valve easy can be opened or closed dependent on working conditions of the internal combustion engine. The ECU may be part of the internal combustion engine and/or the motor vehicle.

Particularly, the means for creating a pressure or subpressure may have at least one connection to a pressure tank, especially a vacuum tank, and the connection may have a controllable valve, for example an electropneumatic valve. With the storage capacity of the pressure tank, the available pressure supply for controlling the intake control valve is provided readily and at any time. Electropneumatic valves may be easy controlled by the ECU.

Advantageously, the means for creating a pressure are designed for creating a subpressure or an overpressure, i.e. either a pressure above or below ambient pressure.

According to another advantageous embodiment of the invention, each connection may be opened or closed by way of an individual intake control valve, each intake control valve may include an individual diaphragm and an individual switch chamber and the switch chambers of at least two of the intake control valves may be interconnected. The switch chambers may also be optimized for each feed pipe. In particular the switch chambers may be different in volume and/or shape. They also may have equal volumes and/or shape. The individual diaphragms may be optimized for each feed pipe too. They may also be optimized for each feed pipe or equal. The intake control valves whose switch chambers are interconnected may be controlled together. The interconnection may be integrated in a part of a common housing. This reduces the required space of intake control valves. Each intake control valve may switch dependent on the individual difference of pressure in the switch chamber and the pressure in the corresponding feed pipe.

Advantageously, the diameter of the diaphragms of at least two of the intake control valves can be different. In this case the evenness and the simultaneousness of the opening phase of the intake control valves can be increased by compensating diaphragm diameter. Advantageously, the diameters of the individual diaphragms may be varied dependent on their positions relative to the connection to means for creating a subpressure.

Particularly, the volumes of the switch chambers of at least two of the intake control valves can be different. The volume of each switch chamber can influence the switch characteristics of the intake control valve. Variations of the switch chamber volumes can be optimized to advantageously achieve evenness and the simultaneousness of the operating phase of the intake control valves.

Advantageously, at least three of the switch chambers can be connected by at least two canals and the flow cross-section of the canals can be different dependent on their position relative to a pressure intake connecting piece. The flow cross-section of the canals can influence the switch characteristics of the intake control valve. Variations of the flow cross-section have good influence on the evenness and the simultaneousness of the operating phase of the intake control valves.

According to a further advantageous embodiment of the invention, the intermediate chamber can lengthen or shorten the path of the air through the feed pipe if the intake control valve is in the opened state. So the output performance of the internal combustion engine and/or the noise emission can be optimized by opening or closing the intake control valves.

Advantageously a pre-stressed spring can apply a force onto or act upon the diaphragm for holding the diaphragm in the closed state particularly in the state of rest. This can prevent that the intake control valve opens uncontrolled.

The above features and advantages and other features and advantages of the present invention are readily apparent from the following detailed description of the best modes for carrying out the invention when taken in connection with the accompanying drawings.

BRIEF DESCRIPTION OF THE DRAWINGS

The accompanying Figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Features of the present invention, which are believed to be novel, are set forth in the drawings and more particularly in the appended claims. The invention, together with the further objects and advantages thereof, may be best understood with reference to the following description, taken in conjunction with the accompanying drawings. The drawings show a form of the invention that is presently preferred; however, the invention is not limited to the precise arrangement shown in the drawings.

Figure 1:
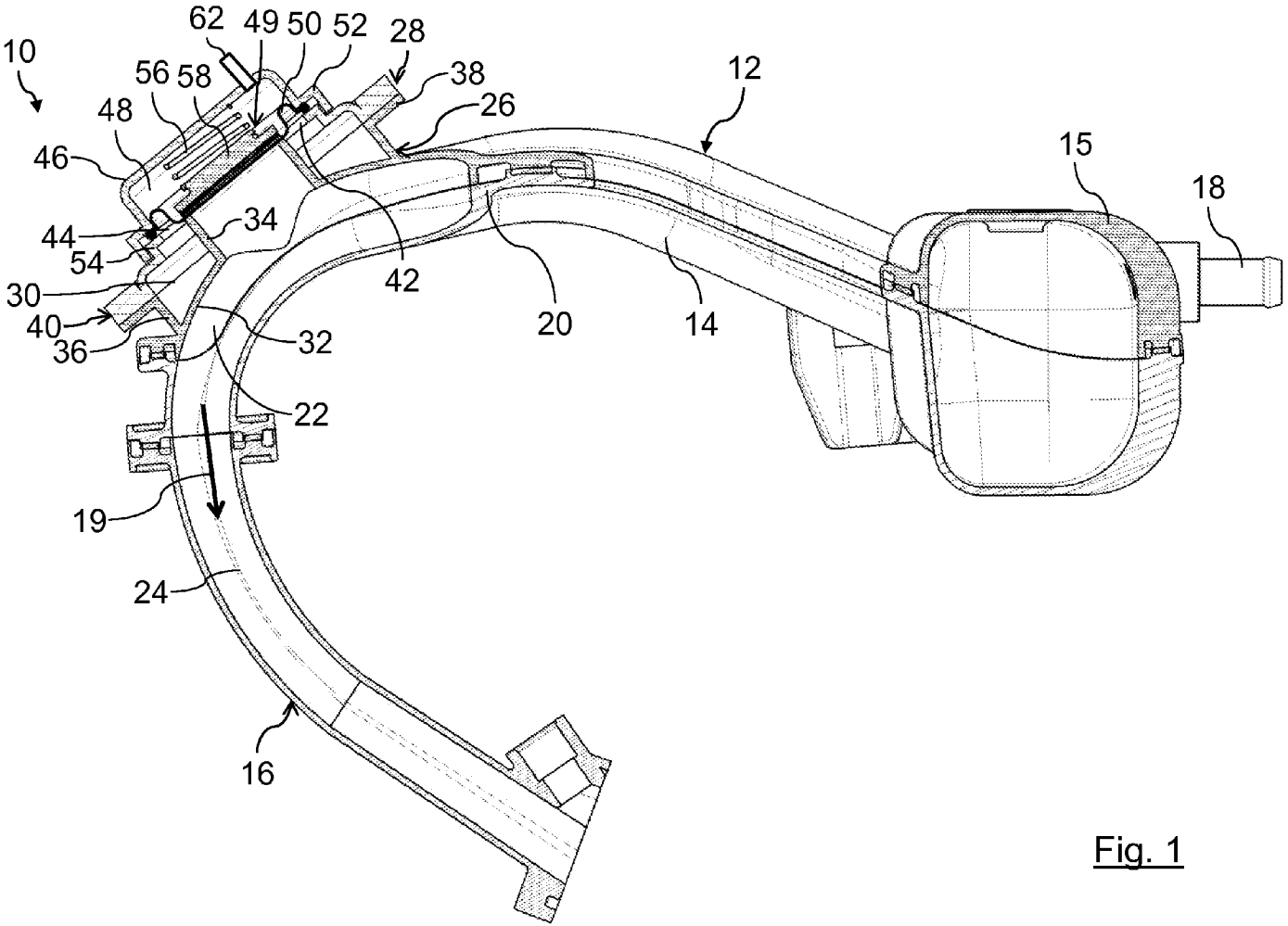
FIG. 1 is a longitudinal section of an intake system of an internal combustion engine with four cylinders, consistent with the present invention.

In the drawings, equal or similar elements are referred to by equal reference numerals. The drawings are merely schematic representations, not intended to portray specific parameters of the invention. Moreover, the drawings are intended to depict only typical embodiments of the invention and therefore should not be considered as limiting the scope of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of apparatus components related to an air intake system of an internal combustion engine. Accordingly, the apparatus components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

FIGS. 1 to 4 depict an intake system 10 of an 4-cylinder internal combustion engine of a motor vehicle.

An intake manifold 12 has four feed pipes 14 which are connected to a plenum chamber 15 at one end and by means of an intermediate flange 16 with intake ports of a not shown cylinder head of the internal combustion engine at the other end. The plenum chamber 15 has an intake connecting piece 18 into which air flows from a not shown air cleaner. The air flows from the plenum chamber 15 to the intake ports as sketched out in FIG. 1 by an arrow 19. The feed pipes 14 and the plenum chamber 15 are made of plastic. The feed pipes 14 are produced by two-shell technique. The plenum chamber 15 also is produced by a two-shell technique.

The feed pipes 14 run parallel to each other. In a bent portion each feed pipe 14 has in its radial outer shell a flange 20 with an opening 22 to an interior volume 24 of the feed pipe 14.

A lower part 26 of a casing 28 of an intermediate chamber 30 is connected with the flange 20 of each feed pipe 14. The intermediate chamber 30 extends across all feed pipes 14. A bottom shell 32 of the lower part 26 forms a part of the respective wall of the feed pipes 14 each. The bottom shell 32 is attached to each flange 20 of the feed pipes 14 by welding or by means of glue.

A duct 34 is formed on the outer side of each bottom shell 32. The duct 34 is open on both sides. On one side it is connected to the interior volume 24 of the respective feed pipe 14.

A side wall 36 of the lower part 26 surrounds all ducts 34. The open edge of the side wall 36 is formed to a surrounding flange 38 for connecting with an upper part 40 of the casing 28.

The upper part 40 forms a partition wall of the casing 28. It extends across all ducts 34. It has four holes 42 each coaxial to one of the ducts 34. The open edges of the ducts 34 are arranged inside the holes 42. The diameters of the holes 42 are bigger than the outside diameters of the ducts 34. Between the outer surface of each duct 34 and the radial outer boundary of the according hole 42 is a surrounding gap 44.

Each hole 42 is covered by a cup-shaped casing 46 of a switch chamber 48 of an intake control valve 49. A diaphragm 50 of each intake control valve 49 is gripped with its edge between a stepped edge 52 of the casing 46 and a collar 54 of the upper part 40. The collar 54 surrounds the hole 42.

A compressing spring 56 of each intake control valve 49 applies a compressive force biasing the diaphragm 50 toward the edge of the duct 34. The spring 56 is supported at one end on the bottom of the casing 46. On the opposing end of the spring, the spring 56 presses against a plate 58 which supports, backs and strengthens the diaphragm 50. The central portions of the diaphragm 50 lies on and is supported by the plate 58. The plate 58 may be made of plastic. The plate 58 is arranged coaxial to the duct 34. The diameter of the plate 58 corresponds to the outer diameter of the duct 34.

Each switch chamber 48 is separated from the intermediate chamber 30 by way of the flexible diaphragm 50. While the diaphragm 50 is flexible, it is also impervious to flow so as to form a closed switch chamber 48 which may receive a subpressure to actuate the intake control valve 49. The switch chamber 48 is fluidically separated from the interior volume 24 of the corresponding feed pipe 14 by the diaphragm 50.

Figure 2:
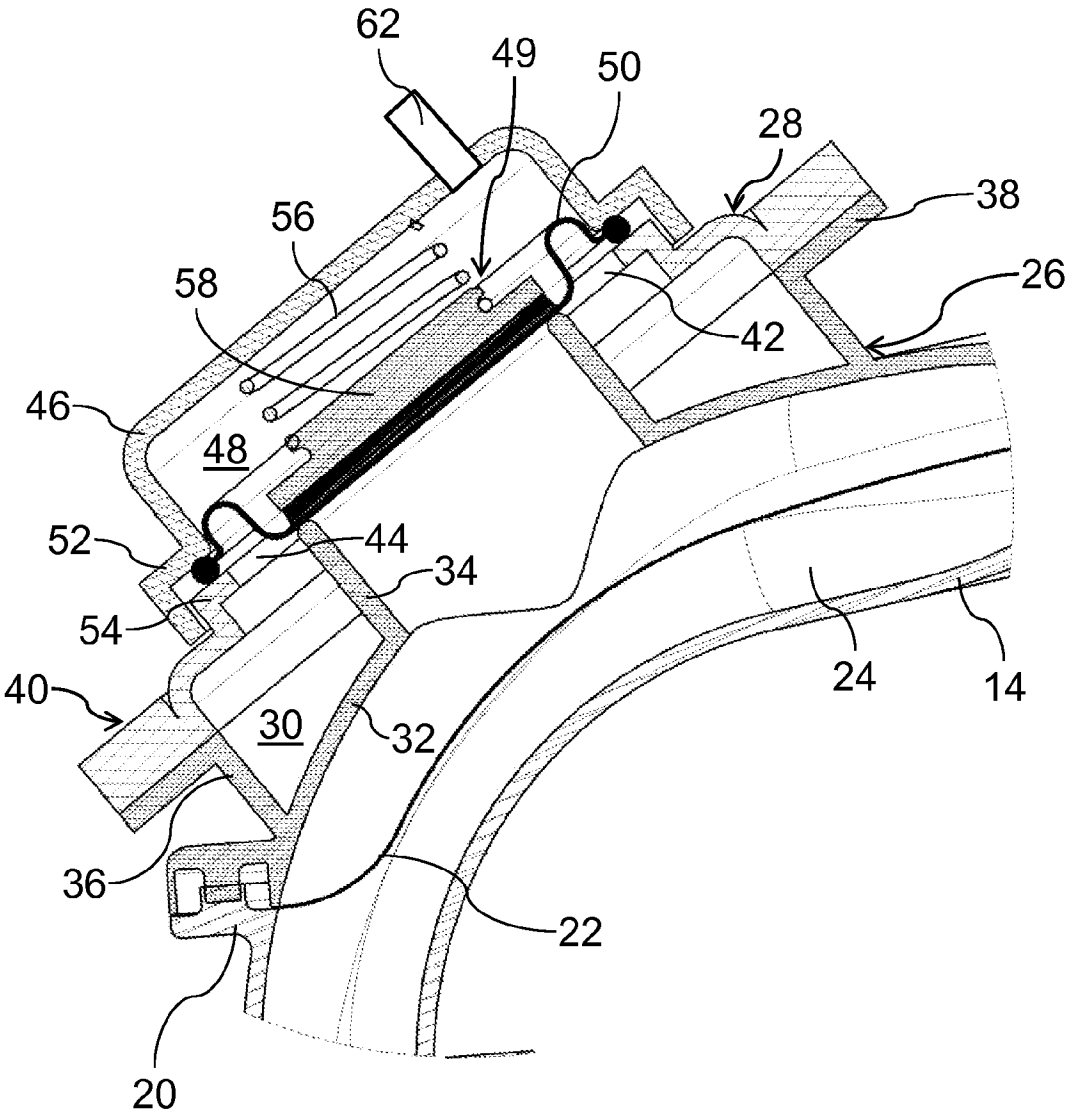
FIG. 2 is a sectional view of the intake system of FIG. 1 in the area of an intake control valve.
Figure 3:
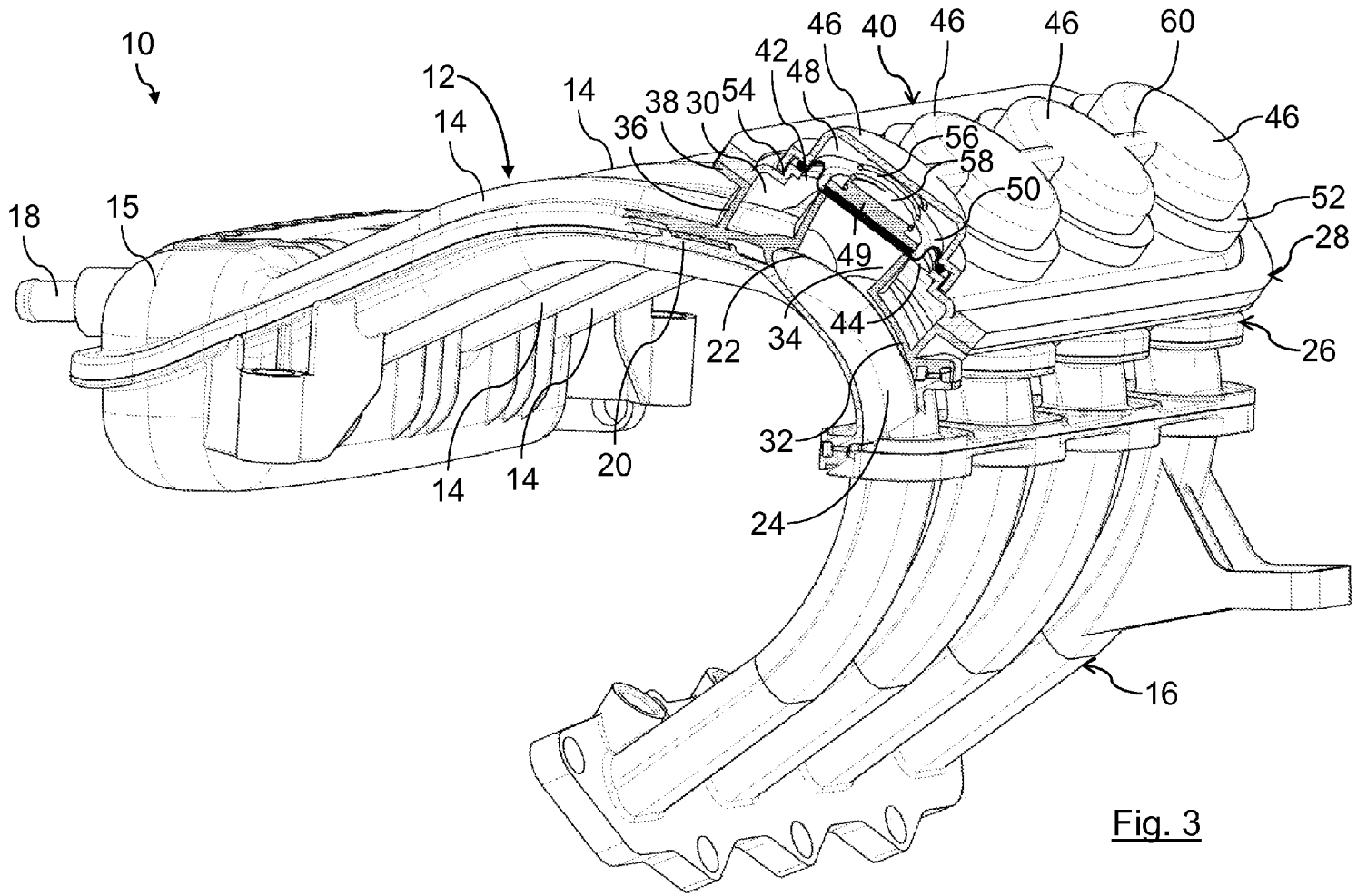
FIG. 3 presents an isometric view of the intake system of FIGS. 1 and 2; one intake control valve is shown in a sectional view.
Figure 4:
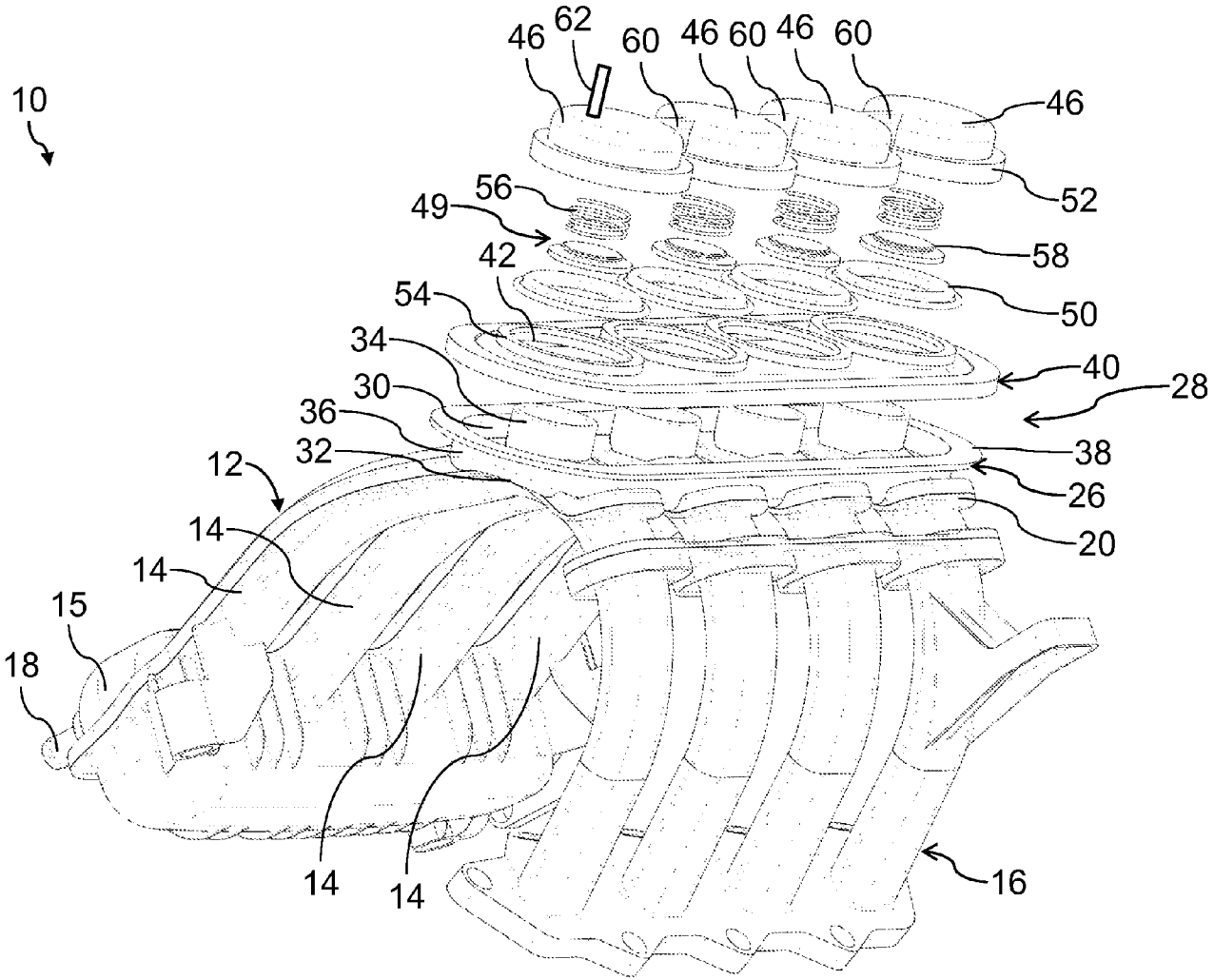
FIG. 4 is an exploded view of the intake system of FIGS. 1 to 3.

In the state of rest, which is shown FIGS. 1 to 3, the pre-stressed spring 56 applies a force onto or acts upon the diaphragm 50 holding it in the closed state of the intake control valve 49 (i.e. sealing against the edge of the duct 34). In the closed state the diaphragm 50 separates or fluidically closes off the immediate chamber 30 from the interior volume 24 of the feed pipe 14.

The adjacent casings 46 are interconnected by means of flow passages or canals 60. So the switch chambers 48 of all intake control valves 49 are fluidically interconnected for common pressure or flow therebetween.

One of the casings 46 has a connecting piece 62 for a not shown pipe to means for creating a subpressure or partial vacuum in the switch chambers 48. The means for creating a subpressure preferably have a connection to a subpressure tank. The connection has an electromagnetic valve which can be controlled by an electronic control unit (ECU) of the internal combustion engine for opening or closing the connection.

In a not shown open state of intake control valves 49 the respective diaphragm 50 releases and moves axially away from the opening of the duct 34. The intermediate chamber 30 then is connected to the interior volume 24 of the corresponding feed pipe 14, permitting flow therebetween.

When the engine operates the intake control valves 49 initially are in the closed state.

Under defined working conditions, which are specified in the ECU, the ECU opens the electropneumatic valve, so that the means for creating a subpressure applies a subpressure in the switch chambers 48 compared to the pressure in the interior volumes 24 of the feed pipes 14. When the subpressure applies a sufficient force on the diaphragm 50 to move the diaphragm 50 away from the duct edge 34 against the biasing of the springs 56, the intake control valves 49 open air can flow from the interior volumes 24 through the duct 34 and the gaps 44 into the intermediate chamber 30. Each duct 34 can be opened or closed by way of an individual intake control valve 49.

Opening and closing the intake control valves 49 according to the working conditions of the engine can increase the output performance of the engine and/or decrease the noise emission and/or reduce the consumption of the engine.

The invention is not limited to intake systems 10 of internal combustion engines of motor vehicles. The invention can also be applied for other kinds of internal combustion engines, particularly industrial engines.

It is also not limited to engines with four cylinders. It can also be used for engines with more or less than four cylinders.

The intake system 10 also can have more than one intermediate chamber 30 with intake control valves 49.

Instead of one individual intake control valve 49 for each duct 34 also one intake control valve can be designed for controlling more than one duct 34 at once.

It is also possible that each switch chamber 48 has an individual connection to means for creating a subpressure.

Instead of interconnecting all switch chambers 48 together only some of the switch chambers can be interconnected in groups for example.

Instead of using equal diaphragms 50 the diameters of the diaphragms of at least two of the intake control valves can be different. The diameters of the diaphragms can vary dependent on their position relative to the correcting piece 62.

Instead of using equal switch chambers 48 the volumes and/or the shapes of the switch chambers of at least two of the intake control valves can be different.

Instead of using substantially similar or equal canals 60, the flow cross-section of the canals can be different. For example the flow cross-section of the canals can be dependent on their position relative to the intake connecting piece 62. For example the internal diameter of the canal 16 connecting the switch chamber 48 having the connecting piece 62 with the second switch chamber 48 can be bigger than the internal diameter of the canal 16 connecting the second switch chamber 48 with the third switch chamber 48 and so on.

The intermediate chamber can also be designed for lengthening or shortening the path of the air through the feed pipes if the intake control valves are in the opened state.

The feed pipes 14 and/or the plenum chamber 15 can also be made of a material different from plastic.

Instead of working with subpressure, the intake control valves with diaphragms may alternately be constructed for being controlled by an overpressure. In this case the means for creating a subpressure are replaced by means for creating an overpressure.

Instead of the electropneumatic valve other kinds of valves, for example an electronically controlled valve or a pneumatically controlled valve, can be used also.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims The invention is defined solely by the appended claims including any amendments made during the pendency of this application and all equivalents of those claims as issued.

The invention claimed is:

1. An intake system of an internal combustion engine, comprising:

an intake manifold (12) including:

a plenum chamber (15) having feed pipes connected thereto;

said plenum chamber connected feed pipes (14) having one end secured to said plenum chamber, each of said plenum chamber connected feed pipes (14) including an intake control valve, an interior volume in flow communication with said plenum chamber, said plurality of feed pipes (14) having an opposing end connected to and with said interior volume in flow communication with respective intake ports of a cylinder head of the internal combustion engine;

a casing (28) arranged on and secured onto an exterior of said plenum chamber connected feed pipes at an intermediate position between said ends of each of said plenum chamber connected feed pipes, said casing (28) having an intermediate chamber (30) therein, said intermediate chamber (30) extending across all of said plenum chamber connected feed pipes (14);

wherein each of said plenum chamber connected feed pipes (14) includes:

a.) a connection duct (34) arranged within an interior of said casing and in an interior of said intermediate chamber (30) within said casing (28), said connection duct (34) having a first end fluidically connected to said interior volume (24) of a respective one of said plenum chamber connected feed pipes (14);

b.) said intake control valve (49) arranged within said casing (28) on an opposing second end of said connection duct (34), each intake control valve (49) having an actuator operable to move said intake control valve between an open position and a closed position, fluidically opening or closing off flow between said connection duct (34) and said intermediate chamber (30);

wherein said control valves of said plenum chamber connected feed pipes (14) are each fluidically connected to and share the same intermediate chamber (30);

wherein flow through said connection duct (34) between said interior volume (24) of the respective one of said plenum chamber connected feed pipes (14) and said intermediate chamber (30) is individually opened or closed by action of its respective intake control valve (49) and it's respective actuator according to working conditions of the engine.

2. The intake system according to claim 1, wherein said intake control valve (49) is controlled by an electronic control unit.

3. The intake system according to claim 2, wherein said actuator includes:

a switch chamber (48) which includes pressure communicating passages or connections (60,62) for communicating an overpressure or subpressure from a means of creating said overpressure or subpressure into said switch chamber (48); and a flexible diaphragm (50) arranged between and separating said switch chamber (48) from said interior volume (24) of its respective feed pipe and from said intermediate chamber (30);

wherein said intake control valve (49) is opened or closed by action of an overpressure or a subpressure acting on said flexible diaphragm (50);

wherein said the means for creating said overpressure or subpressure includes at least one actuation pressure connection connecting said switch chamber (48) to a pressure tank; and wherein said at least one actuation pressure connection includes a pneumatically operated or electrically operated valve, said valve operable to open or close flow through said at least one actuation pressure connection under control of said electronic control unit.

4. The intake system according to claim 3, wherein said pneumatically operated or electrically operated valve is an electrically operated solenoid valve operated electrically by said electronic control unit.

5. The intake system according to claim 3, wherein at least two of said switch chambers (48) of different ones of said plurality of feed pipes are fluidically interconnected for communication of overpressure or subpressure therebetween.

6. The intake system according to claim 5, wherein diameter of the diaphragms (50) of at least two of said intake control valves (49) are different, giving respective ones of said intake control valves (49) a different open/closing or flow characteristic.

7. The intake system according to claim 5, wherein chamber volumes of said switch chambers (48) of at least two of said intake control valves (49) are different, giving respective ones of said intake control valves (49) a different open/closing or flow characteristic.

8. The intake system according to claim 5, wherein said plurality of feed pipes (14) is at least three feed pipes (14);

wherein at least three of said switch chambers (48) are fluidically interconnected by at least two canals (16) communicating said overpressure or subpressure therebetween;

wherein flow cross-section of said canals (60) are different dependent on their position relative to or overpressure/subpressure flow distance from a pressure intake connecting piece (18) on said plenum chamber (15).

9. The intake system according to claim 5, wherein said intermediate chamber (30) or said second intermediate chamber (30) lengthens or shortens a path of the air flow through a respective one of said plurality of feed pipes (14) when the intake control valve (49) is in an open state.

10. The intake system according to claim 5, wherein a pre-stressed spring (56) applies a force onto said diaphragm (50) holding said diaphragm (50) in a closed state when a sufficient overpressure or subpressure is not applied to said diaphragm (50) through said switch chamber (48);

wherein said overpressure or subpressure applied to said switch chamber (48) acts to overcome said force applied by said pre-stressed spring (56) to move said diaphragm (50) into an open state, when said overpressure or subpressure is sufficient to overcome said spring applied force, said diaphragm (50) moves to said open state.

11. The intake system according to claim 3 wherein at least two of said switch chambers (48) of said intake control valves (49) of said plurality of feed pipes (14) are fluidically interconnected together by canals (16) communicating a common overpressure or subpressure to respective diaphragms (50) of said respective intake control valves (49);

wherein said intake control valves (49) include a pre-stressed spring (56) applying a force onto said diaphragm (50) holding said diaphragm (50) in a closed state when a sufficient overpressure or subpressure it not applied to said diaphragm (50) through said switch chamber (48);

wherein said switch chamber (48) overpressure or subpressure is acts to overcome said force applied by said pre-stressed spring (56) to move said diaphragm (50) into an open state.

* * * * *